United States Patent [19]

Hoehn

[11] 4,072,111

[45] Feb. 7, 1978

[54] CONVEYOR CARRIER WITH ACTUATED DOG

[75] Inventor: Robert A. Hoehn, Lenexa, Kans.

[73] Assignee: Mid-West Conveyor Company, Inc., Kansas City, Kans.

[21] Appl. No.: 735,831

[22] Filed: Oct. 26, 1976

[51] Int. Cl.[2] ..... B61B 10/02

[52] U.S. Cl. ..... 104/172 S; 104/96

[58] Field of Search ..... 104/172 S, 96, 89, 94

[56] References Cited

U.S. PATENT DOCUMENTS

| | | | |
|---|---|---|---|
| 3,451,352 | 6/1969 | Curry et al. | 104/172 S |
| 3,618,532 | 11/1971 | Clewett et al. | 104/172 S |
| 3,640,226 | 2/1972 | Klamp | 104/172 S X |
| 3,741,126 | 6/1973 | Ross | 104/172 S X |
| 3,812,787 | 5/1974 | Kling | 104/172 S X |
| 3,889,606 | 6/1975 | Linton | 104/172 S |

*Primary Examiner*—Robert J. Spar

*Assistant Examiner*—Randolph A. Reese

*Attorney, Agent, or Firm*—Fishburn, Gold & Litman

[57] ABSTRACT

In a power and free conveyor system which comprises a train of free trolleys including a leading trolley and one or more following trolleys, one of the following trolleys is provided with a transfer dog that remains fully retracted within the trolley track and out of contact therewith until conveying of the train is to be transferred from a first to a second powered conveying chain. To initiate the transfer, a power dog on the first chain disengages from a drive dog on the leading trolley, and the transfer dog is raised out of the following trolley for engagement with another power dog on the first chain. Engagement of the transfer dog with the power dog is maintained preferably throughout the transfer area until the leading trolley is adjacent to the second conveyor chain for engagement of a power dog thereon with the drive dog of the leading trolley.

10 Claims, 5 Drawing Figures

CONVEYOR CARRIER WITH ACTUATED DOG

BACKGROUND OF THE INVENTION

The present invention pertains to power and free conveyor systems, and more particularly pertains to improved apparatus for transferring the conveying of a train of free trolleys from one powered conveying chain to another.

Power and free conveyor systems typically utilize a train of free trolleys that are interconnected with load bars and which are propelled along a track by means of one ore more powered conveying chains. The trolleys support carriers on which parts are conveyed from one location to another, and the trolley train is propelled by engagement of a power dog on a conveying chain with a driving dog on the leading trolley. To provide a change in conveying speed and/or job spacing, the trolley-carrier assembly is often transferred from one conveying chain to another while remaining on the same load supporting track. This requires that the drive dog on the leading trolley become disengaged from a power dog on the first chain, and that the trolley train be provided with sufficient momentum to propel it along the track to a location where it is adjacent a second conveying chain for engagement of a power dog thereon with the driving dog of the leading trolley.

Prior methods for effecting the transfer of a trolley-carrier assembly from one conveyor chain to another include use of an air cylinder which is actuated at an appropriate time for pushing the assembly toward the other chain, a drop section in a power track, and a transfer dog that is located on one of the trolleys and actuated for engagement with a power dog of the conveyor chain prior to disengagement of the driving dog of the leading trolley from another power dog on the chain. The use of air cylinders is unduly complicated and expensive, whereas use of drop sections in the power track is costly and is accompanied by problems with engineering. Prior actuatable transfer dogs have included components which project beyond the profile of the track and thus cause mounting or interference problems. For one reason or another, therefore, such prior transfer methods and apparatus have not proven altogether satisfactory.

SUMMARY OF THE INVENTION

The present invention is directed towards overcoming the problems and disadvantages associated with means for transferring the conveying of free trolleys from one power chain to another in a power and free conveyor system. A principal object is to provide a following trolley of the train with a transfer dog which remains totally retracted within the trolley track and out of contact therewith until a pivotable arm of the dog is caused to extend out of the track at an appropriate time for engagement with a power dog on an adjacent powered conveyor chain. Other objects and advantages of the invention will become apparent from the drawings, the following description, and the appended claims.

In a power and free conveyor system having a load supporting track with a hollow interior, a leading trolley, and an interconnected following trolley that are conveyed on the track by engagement of a driving dog on the leading trolley with a power dog on a first conveyor chain, the present invention is an improved means for transferring the conveying of the trolleys from one conveying chain to another. The present transfer means comprises a cam located within the hollow interior of the track and a transfer dog that is attached to the following trolley and has a pivotable arm and a cam follower thereon. As the following trolley moves along the track, the cam follower engages the cam and thereby pivots the arm of the transfer dog so that it is caused to extend out of the track for engagement with a power dog on an adjacent conveyor chain. When the following trolley has moved beyond the cam and the cam follower has disengaged therefrom, all parts of the transfer dog are fully retracted within the track and are out of contact therewith. Accordingly, the track can have an uninterrupted external profile, and the transfer dog will not drag on the track or contact anything externally thereof when retracted in a non-operative position within the track. During transfer of the conveying of trolleys from a first to a second conveying chain, the transfer dog remains temporarily engaged with a power dog on the first chain in order to effect the transfer, and retracts into the track automatically upon disengagement of the transfer dog from the power dog and cam.

DESCRIPTION OF PREFERRED AND ALTERNATIVE EMBODIMENTS

Figure 2:
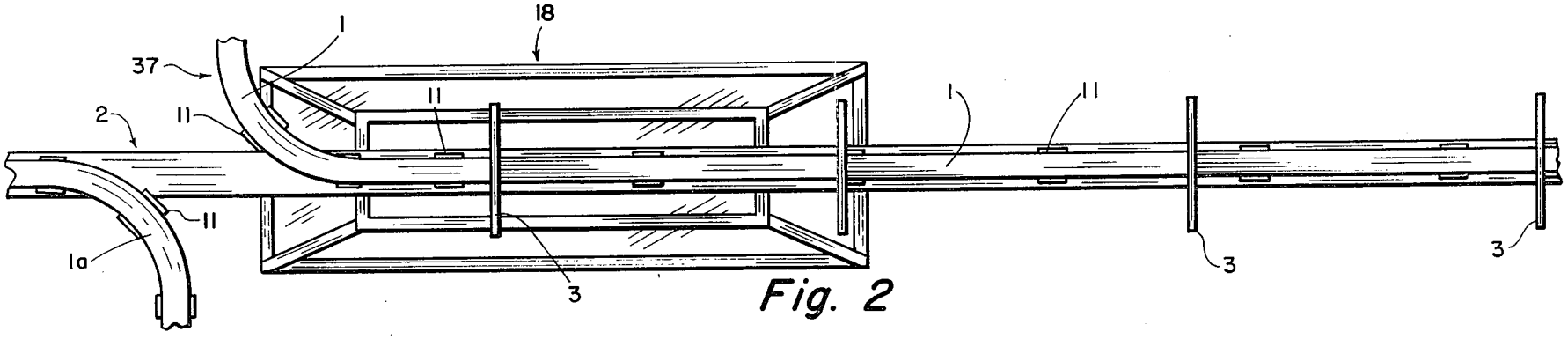
FIG. 2 is a downward view of the conveyor system shown in FIG. 1.

In the drawings, the conveyor system comprises power trolley tracks 1 and 1*a* that are made from I-beams, and a load-conveying free trolley track 2 made from confrontingly aligned channel irons that are spaced apart from each other to provide a track having hollow interior 34. The free trolley track is suspended from the power trolley track by means of yokes 3. Powered conveyor chains 10 and 10*b* are suspended above the free trolley track 1 by means of power trolleys 11 which have rollers 35 that fit into the outer recesses of track 1 and roll on the lower, outwardly projecting flange 36 of the I-beams.

The chains 10 and 10*b* have power dogs 12 and 12*b* thereon for engagement with the drive dog 32 and the transfer dog 15 of the free trolley train which is made up of a leading trolley 4, following trolleys 5, 6 and 7, a parts carrier 18, and load bars 8 having links 9 for interconnecting the trolleys. As shown in the drawings, following trolleys 5 and 6 are also referred to as intermediate trolleys, and following trolley 7 is also referred to as a trailing trolley. The transfer dog 15 is shown in combination with the trailing trolley 7, but can also be used instead with an intermediate trolley such as 5 or 6. The leading and trailing trolleys have provisions for accumulation of free trolley trains; i.e., the leading trolley has an actuator 13 at the front end that is pivoted upward upon striking a cam actuator 14 on a trailing trolley, hence retracting the drive dog 32 so that only the drive dog of the trolley train ahead is engaged with a power dog on one of the chain conveyors. Holdback dog 33 on the leading trolley is stationary and prevents forward coasting of the train as would disengage the drive dog from the power dog.

As was previously indicated, the present invention is directed to means for transferring the conveying of a trolley train from one powered conveyor chain to another; e.g., as when the drive dog 32 must disengage from the power dog 12 when the chain 1 curves to follow power track section 37, and the trolley train and carrier must continue along track 1 until the drive dog 32 can be engaged by a power dog **12*b* on the other chain 10*b*. The present transfer means is represented in detail in FIGS. 3-5 wherein the trailing trolley 7 comprises a main body 16, cam actuator 14, a lug 38 with a channel therein for link 9 (FIG. 1), vertically oriented rollers 19, horizontally oriented rollers 17, the transfer dog which is generally represented at 15, and channel 26 in the main body 16, for attachment of a parts carrier 18**.

Figure 3:
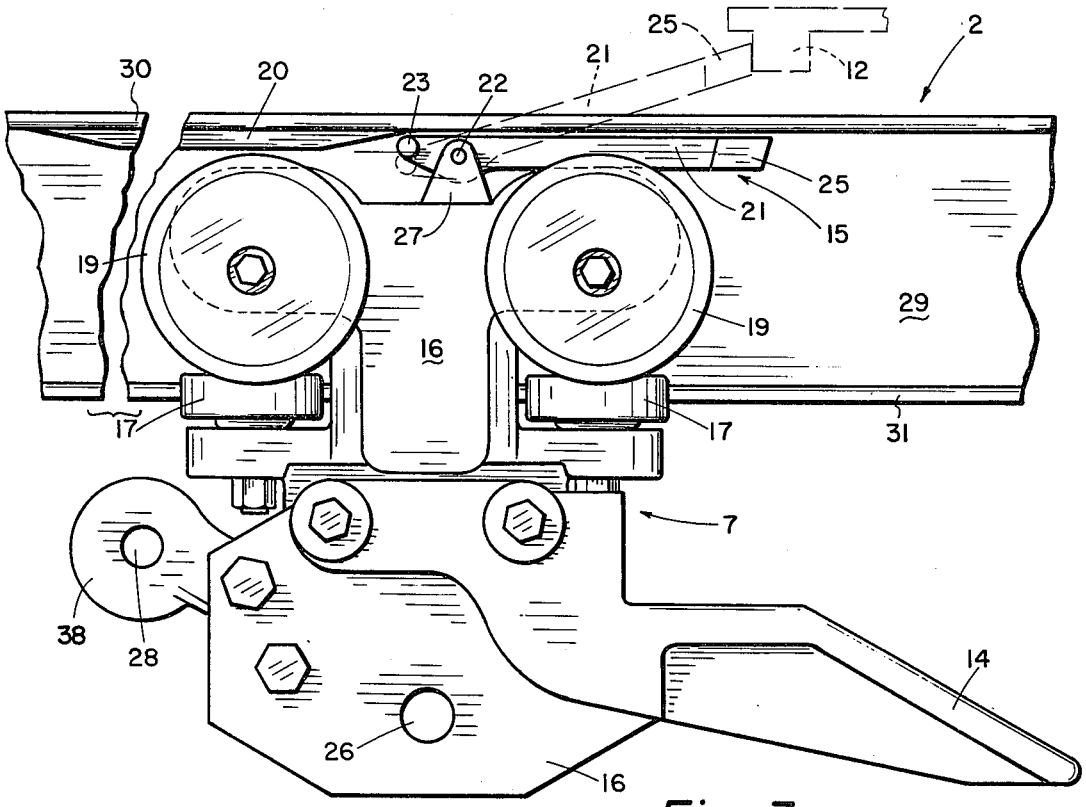
FIG. 3 is an enlarged side elevational view of a following conveyor and a section of track of the conveyor system of FIGS. 1 and 2, and shows details of the transfer dog and the actuating cams therefor.
Figure 5:
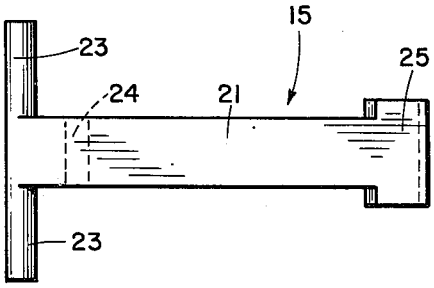
FIG. 5 is a downward view of the transfer dog of the apparatus shown in FIGS. 3 and 4.

Referring to FIG. 5, the transfer dog 15 comprises a rigid pivotable arm 21 with a transversally extending channel 24 therein for a pivot pin 22 (FIG. 3), cam followers 23 which extend transversally outward from the arm 21 ahead of the channel 24, and a power dog engagement member 25 located at the end of the arm 21 opposite the end to which the cam followers are attached. As shown in FIG. 3, the transfer dog is pivotally attached to the body 16 of the trailing trolley by means of a pivot pin 22 which passes through pivot posts 27 on body 16 of the trolley and the pivotable arm 21 of the transfer dog, and arm 21 extends longitudinally with respect to track 2.

Figure 4:
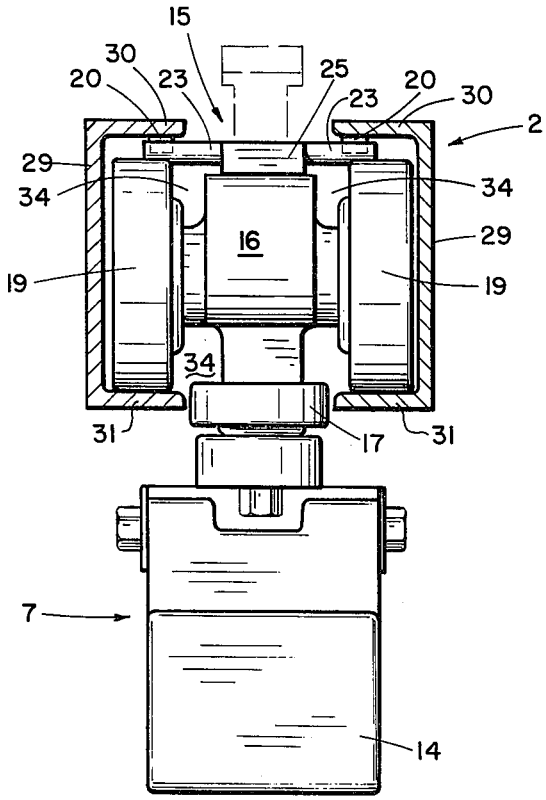
FIG. 4 is a rear view of the apparatus shown in FIG. 3.

In FIG. 4, the track 2 for the free trolleys comprises confrontingly aligned channel irons, each of which includes an upper flange 30 and a lower flange 31, both of which extend horizontally and longitudinally and are interconnected by a vertically and longitudinally extending web 29. The trailing trolley 7 comprises freely rotating wheels 19 on each side of the main body 16 which bear against and roll over the lower flange 31 of the channel irons. Wheels 19 rotate on a horizontal axis and the trolley also has wheels 17 which rotate freely on a vertical axis and are located between the channel irons and positioned to intermittently bear against and roll on the edge of the lower flange 31 to prevent excessive canting of the trolley and binding of wheels 19.

In FIGS. 3 and 4, the transfer dog is shown in a non-operative position by the solid lines and in an operative position during engagement with a power dog 12 of a conveying chain by the dotted lines. The transfer dog is freely pivotable on pin 22 and rests in a substantially level repose on top of the main body 16 of trolley 7 when in the non-operative position. The top of the trolley body 16 thus functions as a stopping means so as to prevent pivoting of the arm 21 by gravity as would result in contact of the forward end thereof and the cam followers with upper flanges 30 of the channel irons. It should further be noted that all components of the transfer dog are located within the hollow interior 34 of the track 2 and are limited in width so that no part of the transfer dog drags on the track or extends from it during repose of the dog in the non-operative position.

Actuation of the transfer dog to an operating position is accomplished by engagement of the cam followers 23 thereon with stationary cams 20 that are located within track 2; i.e., as the trolley 7 rolls forward, the followers 23 engage the cams 20, thereby causing the pivotable arm 21 to rotate on pin 22 and extend upward out of the track. The pivotable arm and the dog engagement member 25 thereon are maintained elevated out of the track by the cams 20 to permit a power dog 12 to engage the member 25, (FIG. 3), and the transfer dog is thereafter maintained in the operating position by the cams which extend a sufficient distance along the track to guarantee positive engagement throughout the transfer area. After disengagement of the cams 20 from the cam followers 23, and disengagement (usually by lateral motion, FIG. 2) of the member 25 from the power dog 12, the pivotable arm 21 of the transfer dog swings downward by gravity so that it again rests on top of the main body 16 of the trolley as shown.

It should be noted that the cams 20 are located inside of the track 2 so that it has an uninterrupted external profile. By combination of the track with the fully retractable transfer dog, a transfer means is provided whereby external projections from the track as might interfere with continuous operation or amount to a safety hazard are eliminated. It will also be appreciated that cams 20 should be sufficiently elongated longitudinally to assure extension of the pivotable arm 21 out of track 2 for a sufficient length of time to assure a positive transfer regardless of surges in chain or carrier motion. Use of two cams 20 in side-by-side relationship is illustrated, such an arrangement being advantageous in combination with the dual cam followers 23 of the transfer dog, but it will be understood that use of only one cam and one cam follower is essential, and that the one or more cams can be attached to components of track 2 other than the upper flanges 30 of the channel iron as shown.

Figure 1:
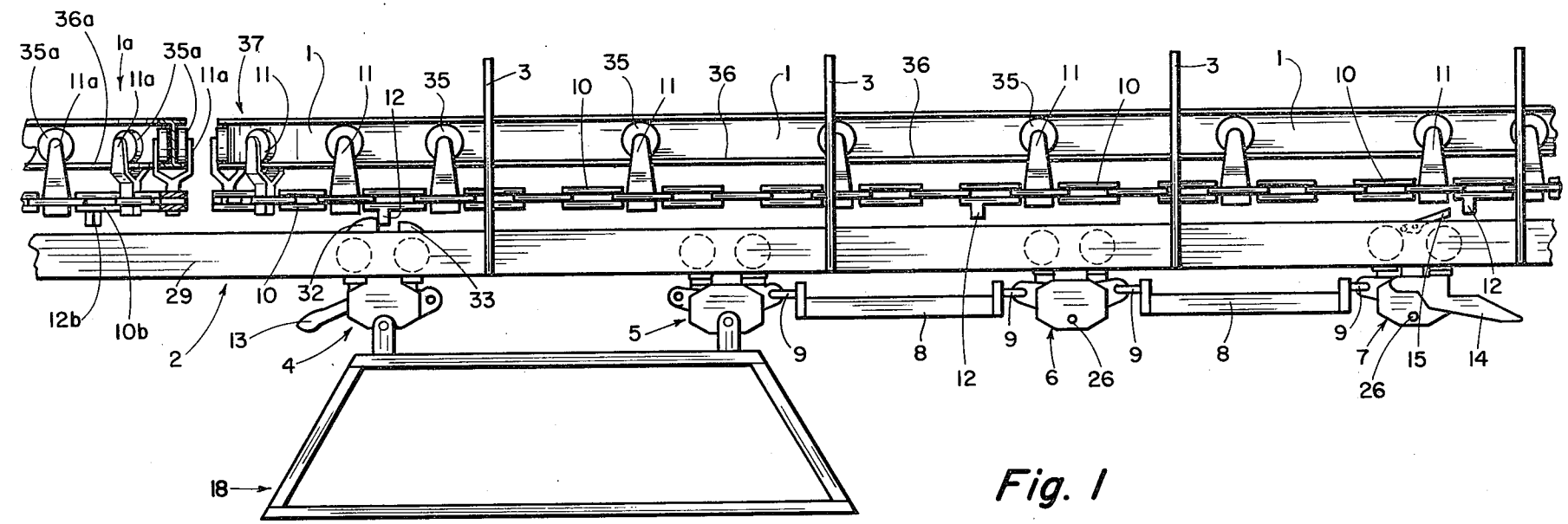
FIG. 1 is a side elevational view of a power and free conveyor system wherein the present conveying transfer means is employed.

With reference to FIG. 1, the trolley train is shown at a location of track 2 where a power dog 12 on the first conveyor chain 10 is almost ready to disengage from the drive dog 32 on the leading trolley 4 as the chain curves in conformity with the bend 37 of power track 1. At the same time, the pivotable arm of the transfer dog has been elevated out of track 2, as previously described, for engagement with another power dog 12 on chain 10 that is adjacent to the pivotable arm. Engagement of the power dog with the transfer dog will be effected at about the same time that the other power dog disengages from the drive dog 32. Accordingly, the powered conveying of the trolley train toward the second conveying chain **10*b* is nearly uninterrupted and is maintained by pushing the train from the rear until the drive dog 32 on the leading trolley 4 can become engaged with a power dog 12*b*** on the second chain.

An improved transfer means for a power and free conveyor system that fulfills the previously stated objects has now been described in detail, and it will be understood that even though the invention has been described with reference to particular embodiments thereof, even other embodiments will become apparent which are within the spirit and scope of the invention as defined in the following claims.

What is claimed and desired to secure by Letters Patent is:

1. In a power and free conveyor system having a load supporting track with a hollow interior, a leading trolley, and an interconnected following trolley that are conveyed on said track by engagement of a driving dog on said leading trolley with a power dog on a first conveyor chain, the improved means for transferring the conveying of said trolleys by said first chain to a second conveyor chain, comprising:

a. a cam having an actuating surface substantially entirely located within the hollow interior of said track; and b. a transfer dog attached to said following trolley, said transfer dog having a pivotable arm and a cam follower thereon, said arm being pivoted by engagement of said follower with said cam surface, and wherein said transfer dog is fully retracted within the interior of said track and out of contact therewith when said cam follower is disengaged from said cam surface, and said pivotable arm of the transfer dog is extended out of the track when the cam follower is engaged with said cam surface.

2. A conveyor system as in claim 1 wherein said cam is attached to said track and extends longitudinally therein, said pivotable arm of the transfer dog extends longitudinally with respect to the track, and said cam follower of the transfer dog extends transversally outward with respect to said arm thereof.

3. A conveyor as in claim 1 wherein said track comprises two confrontingly aligned channel irons which are spaced apart from each other, each of the channel irons having an upper and a lower flange which extend horizontally and are interconnected by an outer, vertically extending web.

4. A conveyor system as in claim 3 wherein a longitudinally extending cam is attached to the upper flange of each of the channel irons and are aligned in side-by-side relationship, and cam followers extend transversally outward from each side of the transfer dog for engagement of the cams.

5. A conveyor system as in claim 4 wherein said trolleys have wheels that roll on the lower flanges of said channel irons, and said transfer dog is pivotally mounted to the top of said following trolley, and wherein said pivotable arm of the transfer dog is pivoted upward and out of the space between the channel irons upon engagement of said followers with said cams.

6. A conveyor system as in claim 5 wherein said cam followers are located at one end of said pivotable arm, and said arm is pivotally attached to said trolley at a point on the arm that is between the end thereof having said cam followers thereon and the other end of the arm.

7. A conveyor system as in claim 6 wherein said pivotable arm of the transfer dog is pivoted downward by gravity when the cam followers thereof are disengaged from said cams, and further comprising an arm stopping means whereby the pivotable arm is prevented from rotation as would cause contact with said track when said followers and cams are not longitudinally aligned, and which maintains the followers in position for engaging the cams when they become longitudinally aligned by movement of the following trolley along said track.

8. A conveyor system as in claim 7 wherein said pivotable arm of the transfer dog is maintained in an upwardly pivoted position by abutment with a power dog on said conveyor chains, and said arm pivots downward by gravity and retracts into said track when said power dog and transfer dog become separated following movement of said following trolley beyond said cams on the track.

9. A conveyor system as in claim 1 wherein said cam is located in said track at a point adjacent said following trolley when said leading trolley is adjacent a point where said power dog is being disengaged from said driving dog on the leading trolley.

10. A conveyor system as in claim 9 wherein said conveyor chains are located above said conveyor track, said chains are supported by power trolleys which roll on I-beams, and said conveyor track is suspended from the I-beams.

* * * * *